United States Patent [19]

Erickson

[11] 4,322,199

[45] Mar. 30, 1982

[54] HIGH SPECIFIC SPEED ROTARY CHAMBER PUMP

[75] Inventor: John W. Erickson, Huntington Beach, Calif.

[73] Assignee: Kobe, Inc., City of Commerce, Calif.

[21] Appl. No.: 23,209

[22] Filed: Mar. 23, 1979

[51] Int. Cl.[3] ..... F04D 1/14

[52] U.S. Cl. ..... 415/89; 415/88

[58] Field of Search ..... 415/88, 89

[56] References Cited

U.S. PATENT DOCUMENTS 3,004,495 10/1961 Macklis ..... 415/89

3,384,023 5/1968 King et al. ..... 415/89

*Primary Examiner*—Philip R. Coe

*Assistant Examiner*—Timothy F. Simone

*Attorney, Agent, or Firm*—William C. Norvell, Jr.

[57] ABSTRACT

An improved design of a rotary pump is provided having a rotary pumping chamber with stationary axially disposed fluid inlet and outlet passages communicating therewith. To increase the rotational speed and the flow capacity, the axial inlet passage is enlarged in diameter to approach the diameter of the rotary pumping chamber. To impart the required rotational velocity to the fluid entering the chamber, vanes are provided in the rotating chamber immediately adjacent the axial annular inlet passage. The fluid pickup and discharge unit is defined by a hollow stationary member disposed in the rotary pumping chamber and having in one embodiment, a plurality of peripherally spaced inlet openings transversely positioned to receive the high rotating velocity fluid therein, and in another modification, a substantially continuous annular inlet opening in a radial plane. In all cases, the rotational energy of the fluid is converted within the pickup unit to a pressure head by flowing radially inwardly, and the pressured fluid is discharged through an axial portion of the pickup unit.

3 Claims, 2 Drawing Figures

HIGH SPECIFIC SPEED ROTARY CHAMBER PUMP

BACKGROUND OF THE INVENTION

1. Field of the Invention

This invention relates to improvements in rotary pumps of the general type having a rotating pump chamber which is supplied with an inlet fluid through an annular axial passage and is provided with a stationary pitot-type pickup tube receiving the high velocity fluid and converting same to a pressured fluid which is discharged through a tube portion extending through the center of the annular inlet passage.

2. Description of the Prior Art

Pumps of the rotary chamber type are shown in U.S. Pat. No. 3,384,024 to W. L. King. It is characteristic of this type of pump that high pressures can be developed, but at the same time, the volume of pressured output fluid produced by the pump is limited. On the other hand, attempts to increase the speed and/or diameter of such pumps are limited by failure of the castings defining the rotating fluid chamber due to centrifugal stresses.

SUMMARY OF THE INVENTION

The invention provides an improved pump of the rotary chamber, axial inlet and discharge type, wherein significantly higher volume fluid output may be obtained, for a given diameter and speed.

A particular object of the invention is to provide a larger diameter, annular axial inlet passage for pumps of the rotary chamber type and to provide rotating vanes immediately adjacent the stationary portions of the inlet passage to impart the required rotational forces to the fluid entering the pump.

Other objects and advantages of the invention will become apparent to those skilled in the art from the following brief description thereof taken in conjunction with the drawings.

DESCRIPTION OF THE PREFERRED EMBODIMENTS

Figure 1:
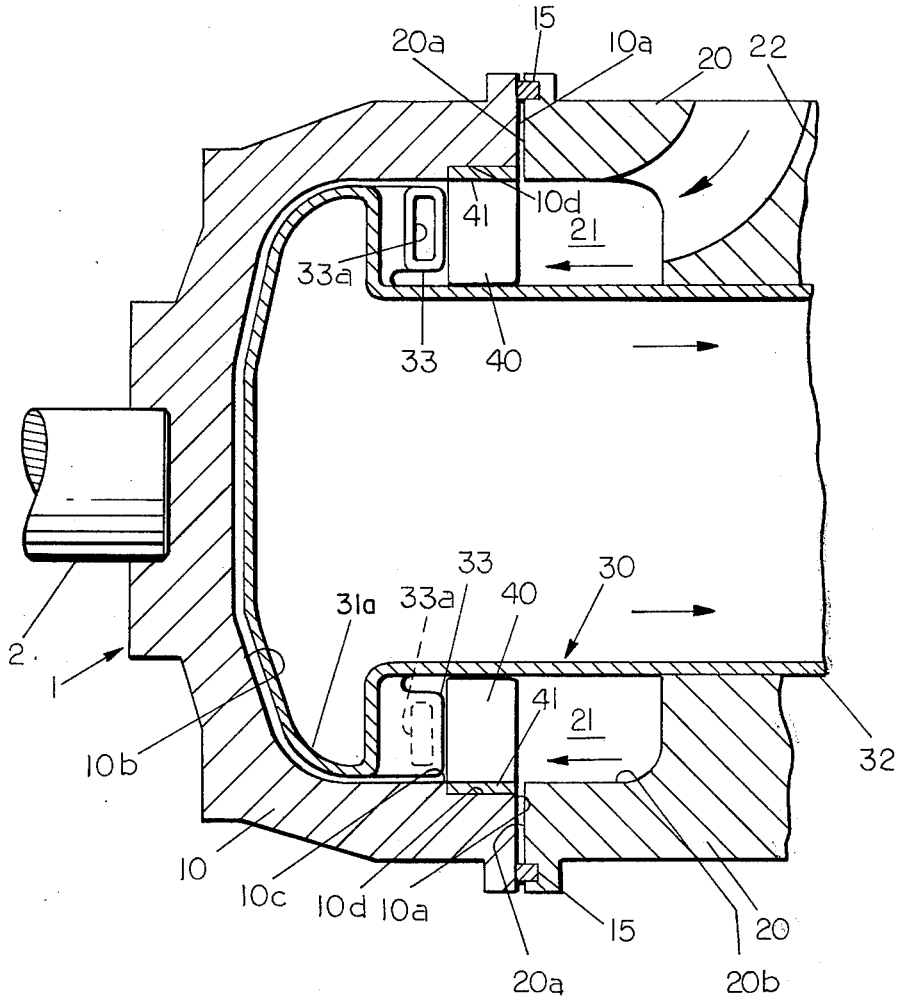
FIG. 1 is a schematic vertical sectional view of a rotary chamber pump embodying this invention.

Referring to the drawings, the rotary chamber type pump 1 embodying this invention includes a cup shaped housing or casting 10 which is mounted on and driven by a rotating shaft 2 in conventional fashion. The radial end face 10*a* of the casting 10 is disposed in juxtaposition to a radial end face 20*a* of a stationary annular housing or casting 20 which is supported in conventional fashion by the casting components of the pump (not shown). A rotating type fluid seal 15 is provided between the stationary face 20*a* and the rotating face 10*a* of the juxtapositioned castings to prevent fluid leakage therebetween. Such seal may obviously be of any conventional type and is only shown in schematic form.

A stationary, hollow fluid pickup member 30 is provided having a bulbous head portion 31 and an axial cylindrical discharge portion 32. The bulbous head portion 31 is disposed within the rotating pumping chamber 10*b* of rotating casting 10 and has a plurality of axially projecting inlet portions 33 spaced around its periphery and having fluid openings 33*a* disposed transversely to the rotary fluid flow to receive the rotating fluid in the rotating pumping chamber 10*b*. The generally conically converging interior wall 31*a* of head portion 31 functions to direct the rotating fluid radially inwardly, and thus partially converts the rotational energy of such fluid into a pressure head. The cylindrical extension 32 of fluid pickup member 30 defines, in cooperation with the internal wall portion 10*c* of the rotating casting 10 and wall 20*b* of the stationary annular casting 20, an annular fluid inlet 21 which communicates with a suitable source of fluid to be pumped through a passage 22 in casting 20. In order to impart the required rotational velocity to the fluid entering the rotating pumping chamber 10*b*, a plurality of pumping vanes 40 are provided on the wall 10*c* of the rotating casting 10 and disposed immediately adjacent the end of the annular fluid inlet passage 21. Vanes 40 may conveniently constitute a ring shaped casting having an annular base portion 41 mounted in an appropriate annular recess 10*d* in an extension of the casting 10 and a plurality of inwardly projecting integral vanes secured to base portion 41 and thus exerting a rotating accelerating action on the fluid entering the rotating pumping chamber 10*b*.

From the foregoing description, it will be apparent to those skilled in the art that the pump construction embodying this invention provides substantially larger axial fluid inlet and discharge passages than those commonly provided in rotary chamber type pumps. As is apparent from the drawings, the entire cross-sectional area of the rotating pumping chamber 10, with the exception of the relatively thin-walled cylindrical extension 32, is substantially equalled by the combined areas of the fluid inlet passage and the fluid outlet passage, thus maximizing the size of such passages without increasing the maximum diameter of the pump. At the same time, the total diameter of the pump has not been significantly increased. Because of the greatly increased size of both the inlet and outlet passages of the pump, the flow capacity of the pump is significantly increased and with the same speed the pump will, of course, produce pressures on the same order as provided by rotary chamber pumps of conventional construction.

Figure 2:
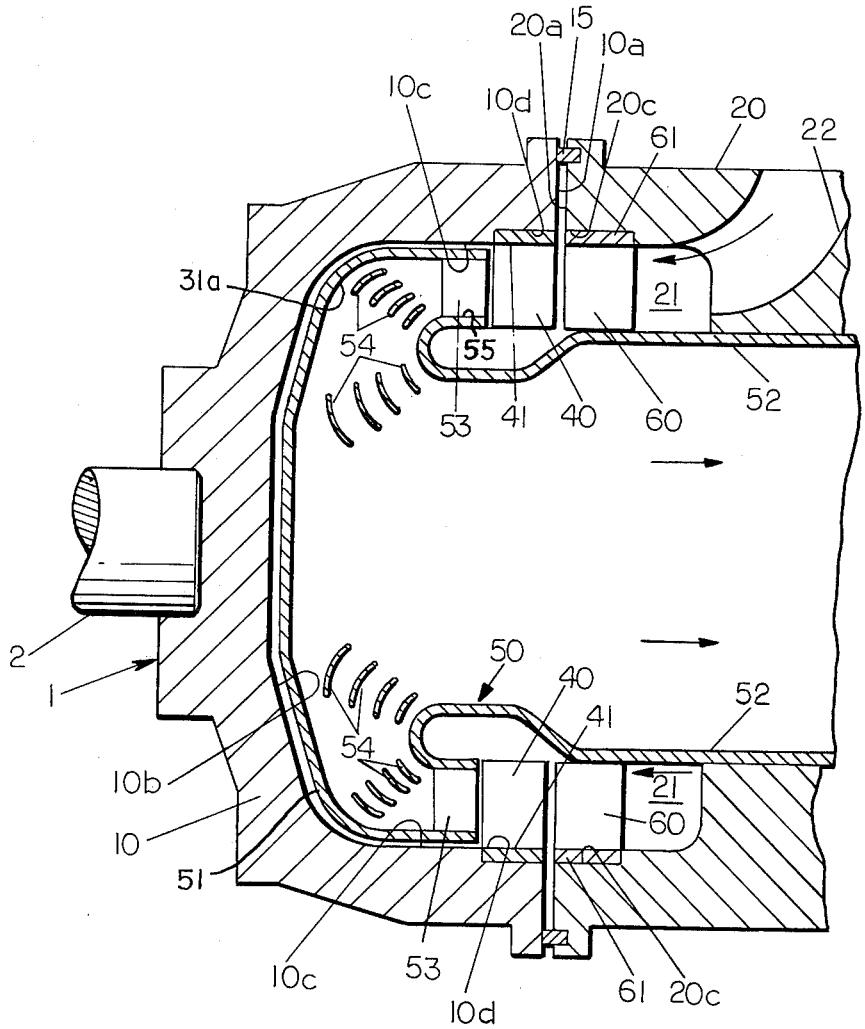
FIG. 2 is a view similar to FIG. 1 of a modified form of rotary chamber pump embodying this invention.

Referring now to FIG. 2, there is shown a modification of this invention. Similar numerals in FIG. 2 refer to similar components as heretofore described in connection with FIG. 1. The major difference lies in the construction of the stationary fluid pickup member 50. Instead of having a plurality of peripherally spaced inlet passages having openings facing the direction of flow of the rotating fluid in the rotating pumping chamber 10*b*, the modification of FIG. 2 provides a substantially continuous annular inlet passage in a radial plane.

Thus, the stationary fluid pickup member 50 is provided with a bulbous head portion 51 and an axially extending cylindrical portion 52 defining the outlet for the pressurized fluid. The inlet to the interior of the pickup member 50 is defined by a substantially continuous annular opening 55 which is interrupted only by a number of peripherally spaced, fluid directing vane members 53 which also provide structural connection of the bulbous head portion 51 to the cylindrical axial extension portion 52. Additionally, to assist in the conversion of the rotational energy of the fluid directed into the intake opening 55 by the rotating vanes 40, a plurality of arcuate fluid directing members 54 may be provided within the interior of the fluid pickup member 50 so that the rotating energy of the fluid entering the fluid pickup member is converted into a pressure head causing the fluid to flow axially outwardly through the discharge passage defined by the cylindrical axial extension portion 52.

A still further modification of this invention is illustrated in FIG. 2 in the provision of an annular ring of stationary fluid directing vanes 60 provided in the end of the annular fluid inlet passage 21. Vanes 60 may be integrally formed on a ring 61 which is suitably mounted within an annular recess 20*c* provided in the interior bore of the stationary casting 20.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A rotary pump comprising: a rotating housing defining a generally cylindrical fluid chamber; an annular, axial extension disposed on the perimeter of said housing and having a bore diameter substantially equal to the diameter of said fluid chamber; a stationary annular housing sealingly engagable with said axial extension; a stationary hollow, fluid pickup member having an enlarged head portion thereof disposed in the radially outer portions of said rotating fluid chamber; said head portion having openings therein to receive rotating fluid; another smaller diameter, thin-walled tubular portion on said fluid pickup member extending axially concentrically through said axial extension and said stationary housing to define a pressured fluid outlet, all of the annular space between said other tubular portion and the inner wall of said axial extension constituting an annular fluid inlet passage producing axial flow of fluid toward said fluid chamber; the fluid flow areas of said inlet and outlet passages being substantially equal to the cross-sectional area of said pumping chamber less the area of said thin-walled tubular portion, and vane means on said axial extension projecting into said annular fluid inlet passage for rotating the axially moving fluid passing therethrough prior to entry into said rotating fluid chamber.

2. The combination defined in claim 1 wherein the rotating fluid enters said openings in said head portion at high velocity and the interior wall of said head portion of said pickup member is shaped to convert the high rotational velocity energy of fluid entering said tubular portion into a lower velocity pressurized fluid for discharge through said fluid outlet.

3. The apparatus defined in claim 1 further comprising a plurality of fluid directing vanes mounted within the fluid passage defined by said pickup member, said vanes being positioned to assist in the conversion of the velocity energy of the entering fluid into pressure.

* * * * *